US008534012B2

(12) United States Patent
Wood

(10) Patent No.: US 8,534,012 B2
(45) Date of Patent: Sep. 17, 2013

(54) TRIM MOLDING STRUCTURE

(75) Inventor: James Wood, Muncy, PA (US)

(73) Assignee: Woodcelli Enterprises, LLC, Williamsport, PA (US)

( * ) Notice: Subject to any disclaimer, the term of this patent is extended or adjusted under 35 U.S.C. 154(b) by 690 days.

(21) Appl. No.: 12/494,884

(22) Filed: Jun. 30, 2009

(65) Prior Publication Data

US 2010/0326585 A1 Dec. 30, 2010

(51) Int. Cl.
*E06B 1/04* (2006.01)

(52) U.S. Cl.
USPC ..... 52/211

(58) Field of Classification Search
USPC ..... 52/1, 232, 211, 213, 717.01, DIG. 4
See application file for complete search history.

(56) References Cited

U.S. PATENT DOCUMENTS

| | | | | | |
|---|---|---|---|---|---|
| 1,781,773 | A | * | 11/1930 | Baum | 52/213 |
| 1,806,647 | A | * | 5/1931 | Rose | 52/213 |
| 1,821,254 | A | * | 9/1931 | Baum | 52/213 |
| 3,107,759 | A | | 10/1963 | Day et al. | |
| 3,148,754 | A | * | 9/1964 | Nardulli | 52/204.5 |
| 3,245,124 | A | | 4/1966 | Faske et al. | |
| 3,654,731 | A | * | 4/1972 | Jellinek | 49/504 |
| 3,730,577 | A | | 5/1973 | Shanok et al. | |
| 4,079,558 | A | * | 3/1978 | Gorham | 52/202 |
| 4,094,112 | A | | 6/1978 | Smith et al. | |
| 4,128,977 | A | | 12/1978 | Schubeis | |
| 4,152,873 | A | * | 5/1979 | Burke | 52/1 |
| 4,387,541 | A | * | 6/1983 | Boomershine | 52/202 |
| 4,409,758 | A | * | 10/1983 | Dickerson et al. | 49/463 |
| 4,505,080 | A | * | 3/1985 | Sailor | 52/211 |
| 4,592,180 | A | * | 6/1986 | Gerritsen | 52/203 |
| 4,819,392 | A | * | 4/1989 | Day | 52/211 |
| 5,038,538 | A | * | 8/1991 | Rozon | 52/213 |
| 5,775,045 | A | | 7/1998 | Hill | |
| 6,073,675 | A | | 6/2000 | Dannaher | |
| 6,173,542 | B1 | | 1/2001 | Wright | |
| 6,381,915 | B1 | * | 5/2002 | Wood | 52/718.06 |
| 6,688,029 | B1 | | 2/2004 | Dunn | |
| 6,807,783 | B2 | * | 10/2004 | Lee | 52/473 |
| 2005/0262787 | A1 | | 12/2005 | Goss | |
| 2005/0284030 | A1 | * | 12/2005 | Autovino et al. | 52/1 |

* cited by examiner

*Primary Examiner* — Mark Wendell
*Assistant Examiner* — Keith Minter
(74) *Attorney, Agent, or Firm* — Wong, Cabello, Lutsch, Rutherford & Brucculeri, LLP

(57) ABSTRACT

A trim molding structure that uses at least one magnet to attach to a metal frame such as a metal door frame and a metal window frame is presented. At least one magnetic element is affixed to a trim member of a trim molding structure. The magnetic element can be affixed to the trim member using various means such as an adhesive material that loses adhesiveness when its temperature exceeds approximately its temperature limit. When the temperature of the adhesive material exceeds approximately its temperature limit, the adhesive material loses adhesiveness and releases the trim molding structure from the metal frame. An intumescent material that expands when its temperature exceeds approximately its activation temperature can be attached between a trim member and a metal frame. In case of fire, the intumescent material expands and pushes the trim molding structure away from the metal frame when the temperature of the intumescent material exceeds approximately its activation temperature. In an alternative embodiment, the intumescent material can be replaced by a spring.

31 Claims, 9 Drawing Sheets

TRIM MOLDING STRUCTURE

FIELD OF THE INVENTION

Embodiments of this invention relate to a trim molding structure for use with metal door and window frames by making use of magnetic properties of the metal frame.

BACKGROUND

Metal frames such as door and window frames are widely used in commercial construction. These metal frames are generally less expensive and more durable than comparable wooden frames, and they have the added benefit of better fire resistance than wooden frames. Metal door and window frames are commonly manufactured from steel and other metals. The exposed side of an installed metal door or window frame is typically finished with paint and has minimal, if any, decorative appearance.

Because of the plain appearance of metal door and window frames, it is sometimes desirable to overlay such frames with decorative trim molding. However, it is often expensive and time consuming to install and remove trim moldings. Further, trim molding installation can be labor intensive commonly involving the use of nails, screws or similar mechanical fastening devices to secure the trim molding to the frame or the adjacent wall. Thus, it is likely that the metal frame and the wall surrounding the metal frame would be damaged during installation and removal of the trim molding.

Past attempts to overcome these problems have involved use of complimentary door frame and trim molding designed specifically to fit each other. Such an approach is contemplated in U.S. Pat. No. 4,094,112 to Smith et al. Another similar approach is demonstrated in U.S. Pat. No. 3,107,759 to Day et al. These past approaches are directed at the installation of a trim molding that is specifically designed to fit a door frame that is manufactured with particularized attachment structures to aid in the installation. Additionally, these approaches do not address the installation of trim molding on existing metal frames that do not have the attachment structures designed to fit a specific trim molding type.

Another approach intended to ease installation of trim molding on door and window frames is described in U.S. Pat. No. 6,381,915 to Wood. Wood presented a mounting device for trim moldings. While this approach does not require complimentarily designed frame and trim molding, it requires complimentarily designed trim molding and mounting structure. Further, installation of the mounting structure requires use of mechanical fastening devices such as screws to be placed through the frame. Thus, installation and removal of the mounting device disfigures the frame.

Past approaches do not address the increased risk of the spreading of fire that is associated with trim moldings attached to metal frames. Ignitable materials such as wood are often used to make trim moldings for metal frames. When an ignitable material is used to make a trim molding, existing approaches diminish the fire resistance quality associated with metal door frames. If, for instance, there is fire inside a room that has trim moldings installed on the outside facing side of its metal door frame, existing approaches facilitate the spreading of fire from the outside of the room. Three common standards for fire test of door assemblies are UL 10C, NFPA 252, and ASTM 2074.

The subject matter of the present disclosure is directed to overcoming, or at least reducing the effects of, one or more of the problems set forth above.

SUMMARY

A trim molding structure having at least one trim member that has at least one magnetic element attached to the trim member is used to decorate metal frames such as metal door and window frames. The magnetic element that is affixed to the underside of the trim member can preferably be a rare earth magnet. Alternatively, the magnetic element can be a metal clip that has a magnet, preferably a rare earth magnet, magnetically attached thereto. Preferably, several magnetic elements are affixed to the underside of the trim member. The magnetic element can be affixed to the underside of the trim member by an adhesive material, mechanical devices such as screws and nails or a combination of adhesive material and mechanical fastening devices. The trim member that has a magnetic element affixed thereto is then attached to a flange of a metal frame.

In one embodiment, the adhesive material has a temperature limit such that it loses adhesiveness when its temperature exceeds its temperature limit. The temperature of the adhesive material can exceed its temperature limit because of conditions such as nearby fire. Similarly, even though the exact temperature depends on several conditions, the trim member has an ignition temperature beyond which it would ignite. The temperature limit of the adhesive material is preferably below the ignition temperature of the trim member such that the adhesive material loses adhesiveness before the trim member ignites. When the adhesive material loses its adhesiveness because its temperature exceeds its temperature limit, the adhesive material releases the magnetic element from the trim member, thereby releasing and separating the trim member from the flange of the metal frame.

The trim molding structure can further comprise an intumescent material that is placed between a flange of a metal frame and trim member. The intumescent material can be affixed to the flange or the underside of a trim member. Further, the intumescent material has an activation temperature such that it expands when its temperature approximately exceeds its activation temperature. Preferably, the activation temperature of the intumescent material is higher than the temperature limit of the adhesive material and lower than the ignition temperature of the trim member. Thus, in case of a nearby fire that raises the temperature of the adhesive and intumescent materials, the adhesive material first loses its adhesiveness and releases the trim member from the metal frame. The intumescent material then expands and pushes the trim member away from the flange of the metal frame before the trim member catches fire.

In one embodiment, a spring can be placed between a trim member and a flange. Preferably, the spring is compressed between the trim member and the flange. In case of fire, when the adhesive material used to attach the magnetic element loses its adhesiveness, the spring pushes the trim member away from the flange of the metal frame before the trim member ignites and spreads the fire.

In one embodiment, the trim molding structure comprises at least one vertical trim member and one horizontal trim member. A vertical trim member is used to decorate a vertical flange of a metal frame such as a hollow metal door frame. A horizontal trim member is used to decorate the horizontal flange of a metal frame as the top horizontal flange of a metal door frame. The vertical trim member can abut against the horizontal trim member. Alternatively, the vertical trim member can fit into a recessed section in the horizontal trim member which allows use of a fixed length vertical trim member on flanges of different height.

Additionally, when a flange of a metal frame protrudes far from a wall adjacent to the metal frame, there may be a gap between the trim member attached to the flange of the metal door frame and the wall adjacent to the metal door frame. In such cases, an adapting structure can be connected to the trim member so as to close the gap that might otherwise exist between the trim member and the wall adjacent to the metal door frame.

Accordingly, the trim molding structure for metal frames significantly eases the installation and removal process. Further, installation and removal of the trim molding structure does not disfigure or damage the metal frame or the wall adjacent to the metal frame. It also allows for adaptability to different site conditions because the magnetic elements do not require physical contact to attach the trim molding structure to the metal frame. Selection of magnet types can also be made based on site conditions, and magnets can be swapped at the time of installation. Additionally, the trim molding structure maintains the fire resistance quality of the metal frame to which it is attached by detaching from the metal frame before the trim molding structure ignites.

The foregoing summary is not intended to summarize each potential embodiment or every aspect of the present disclosure.

DETAILED DESCRIPTION

Figure 1:
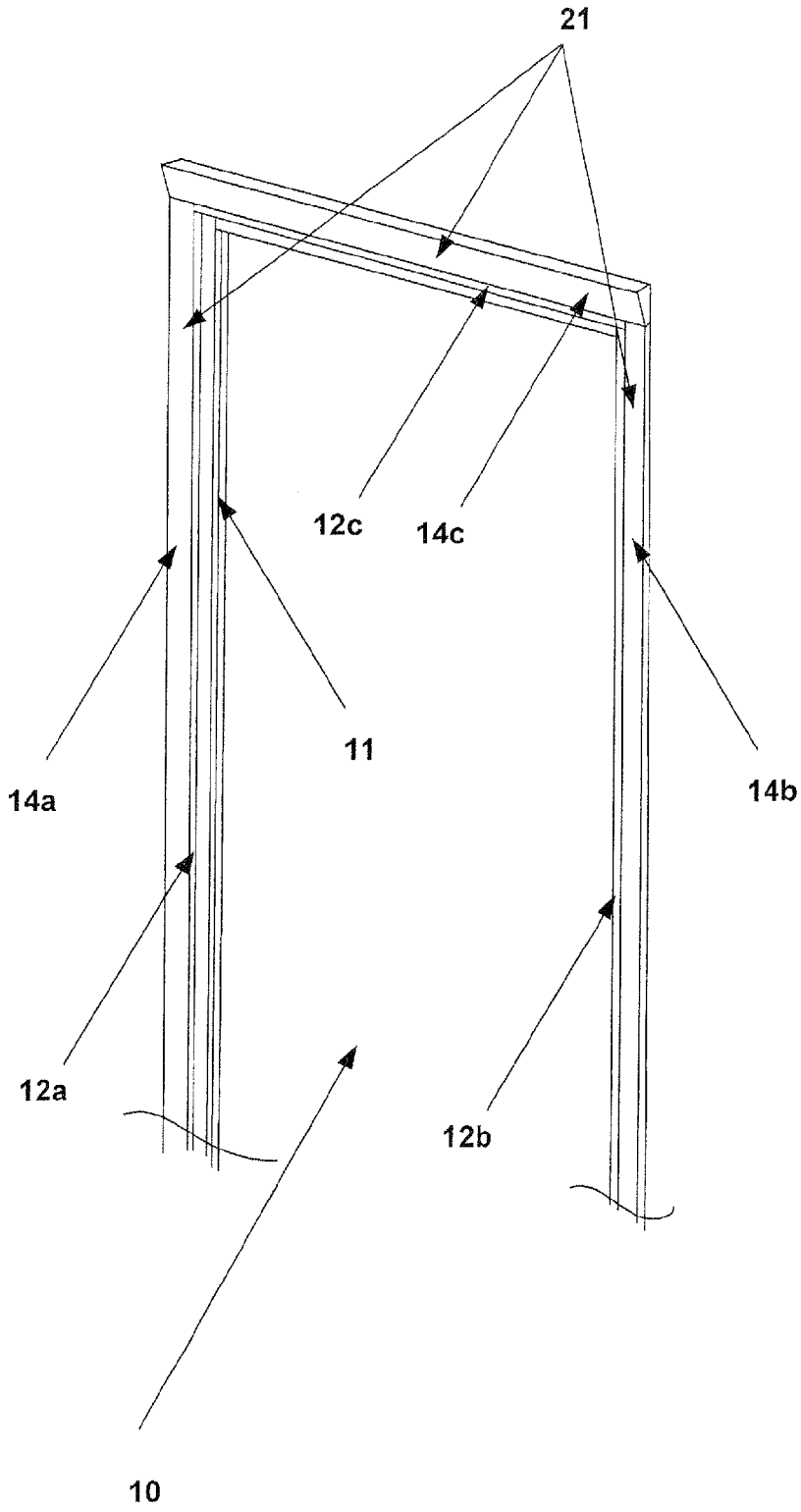
FIG. 1 illustrates a slightly angled frontal view of a door that has a metal door frame with a trim molding structure attached thereto.

Referring now to the drawings, in which like numerals represent like components throughout the several views, FIG. 1 shows a typical door 10 with a metal frame 11. A trim molding structure is attached to the flanges 12 of the metal frame 11. The trim member 14 can be made of a material such as wood. A trim member 14*a* is attached to one vertical flange 12*a* and another vertical trim member 14*b* is attached to another vertical flange 12*b*. A horizontal trim member 14*c* is attached to the top horizontal flange 12*c* of the metal frame 11. The outer surface 21 of the trim members 14 can have various decorative appearances.

Figure 2:
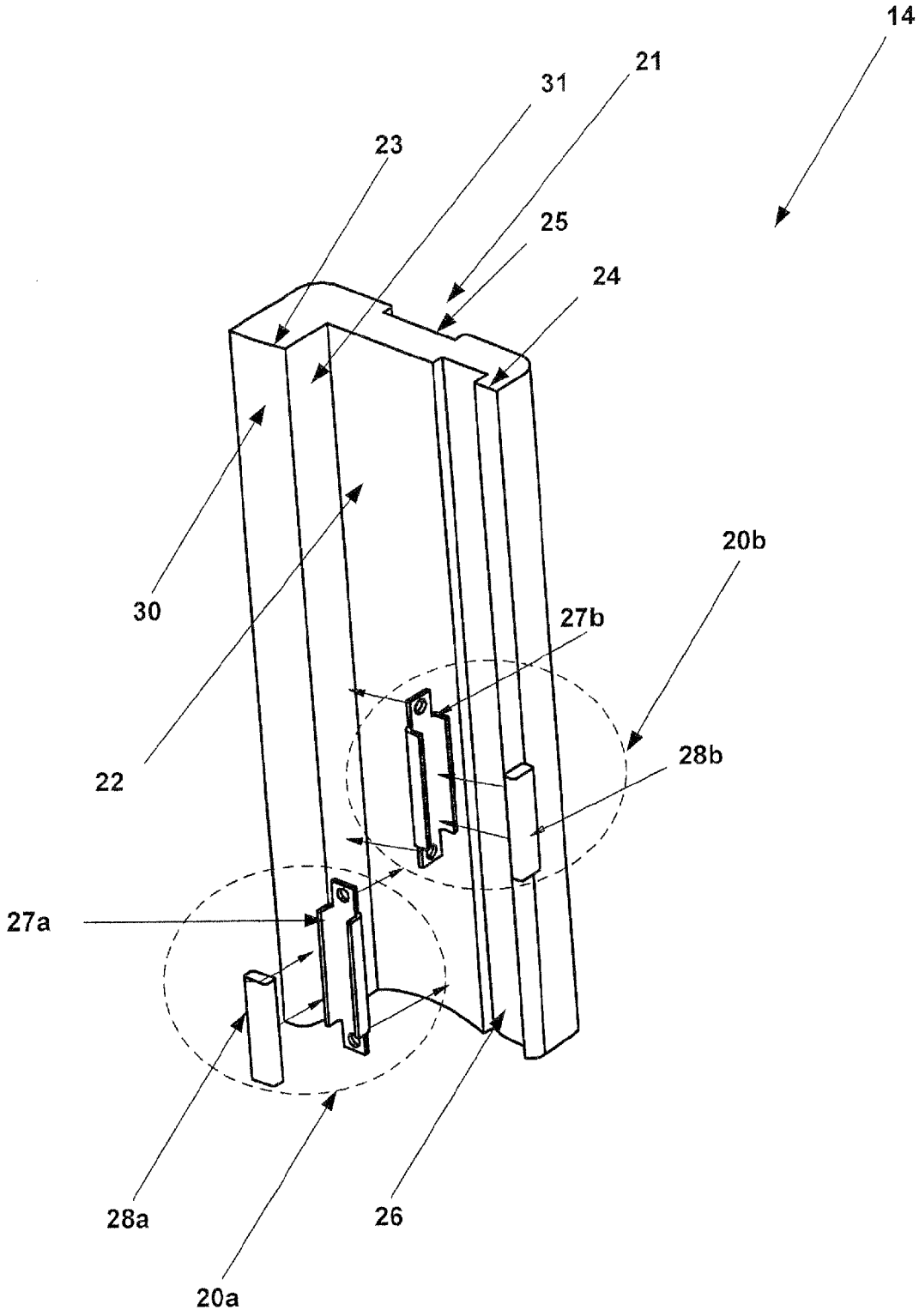
FIG. 2 illustrates an underside of a trim molding structure.

In the preferred embodiment of the trim molding structure shown in FIG. 2, a trim member 14 of the trim molding structure has an outer surface 21, an underside 22, a back leg 23 at one end and a front leg 24 at the opposite end from the back leg 23. The outer surface 21 has a decorative groove 25. The underside 22 has a groove 26. Within the groove 26 of the underside 22, a magnetic element 20*a*, which includes a metal clip 27*a* and a magnet 28*a* as a preferred embodiment, is affixed. The back leg 23 comprises a bottom portion 30 and an inner side 31. Another magnetic element 20*b*, which also includes a metal clip and a magnet as the preferred embodiment, is affixed to the inner side 31 of the back leg 23.

Continuing with the preferred embodiment of the trim molding structure, the trim member is made of wood. While the exact ignition temperature depends on various conditions, a trim member that is made of wood has a typical ignition temperature above approximately 500 degrees Fahrenheit. The ignition temperature is the temperature above which a material used to make the trim member would ignite. The metal clip 27 that is attached to the underside 22 of the trim member 14 is made of a magnet attracting material such as steel. The magnet 28 which is magnetically affixed to the metal clip 27 is used to magnetically attach the trim member 14 to the flange 12 (FIGS. 3*a* and 3*b*) of the metal frame 11 (FIGS. 3*a* and 3*b*.)

Many types of magnet 28 can be used to magnetically attach the trim member 14 to a flange 12. Many kinds of magnets 28 can also be magnetically affixed to the metal clip 27. In the preferred embodiment, the magnet 28 is a rare earth magnet such as a neodymium magnet. The magnet 28*a* is intended to magnetically attach the trim member 14 to the flange 12. The magnet 28*a* does not need to make physical contact with the flange 12 to magnetically attach the trim member 14 thereto. Similarly, the magnet 28*b* does not need to make physical contact with the backend 33 (FIGS. 3*a* and 3*b*) of the flange 12 to magnetically attach the trim member 14 thereto.

The metal clip 27 that holds the magnet 28 can be affixed to the underside 22 of the trim member 14 by an adhesive material, mechanical fastening devices such as screws and nails or a combination of adhesive material and mechanical fastening devices. In the preferred embodiment, an adhesive material is used to affix the metal clip 27 to the trim member 14. The adhesive material has a temperature limit beyond which it loses its adhesiveness. In other words, when the temperature of the adhesive material approximately exceeds its temperature limit, the adhesive material loses its adhesiveness. An example of an adhesive material with such a characteristic is 3M 3747—3M Scotch-Weld Hot Melt Adhesive. The 3M adhesive material preferably loses adhesiveness when its temperature exceeds approximately 220 degrees Fahrenheit. Thus, in case of a nearby fire that raises the temperature of an adhesive material, the adhesive material loses its adhesiveness and releases the trim member 14 from the flange 12 before the trim member 14 ignites and helps spread the fire.

Figure 3A:
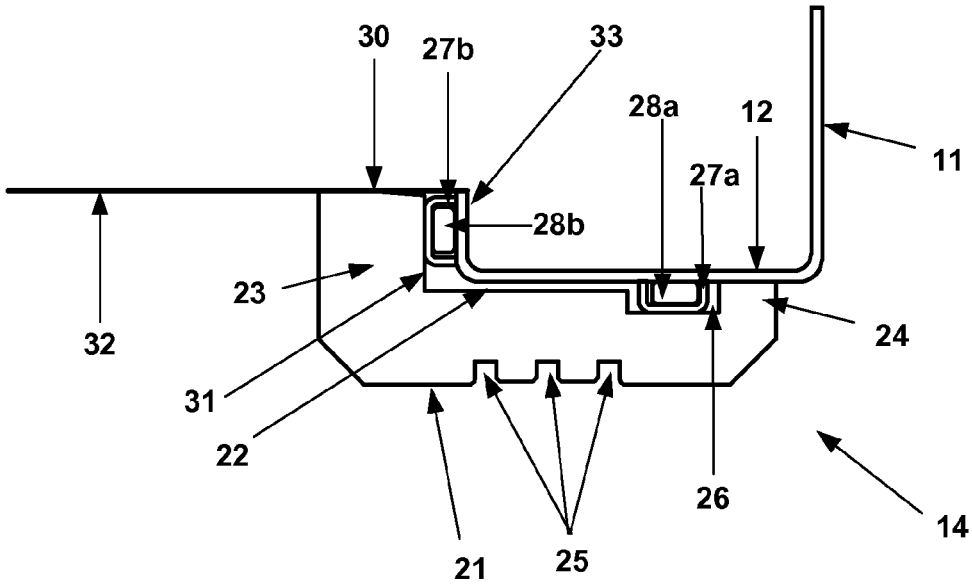
FIG. 3*a* illustrates a cross sectional view of a trim molding structure that is attached to a left vertical flange of a metal frame.
Figure 3B:
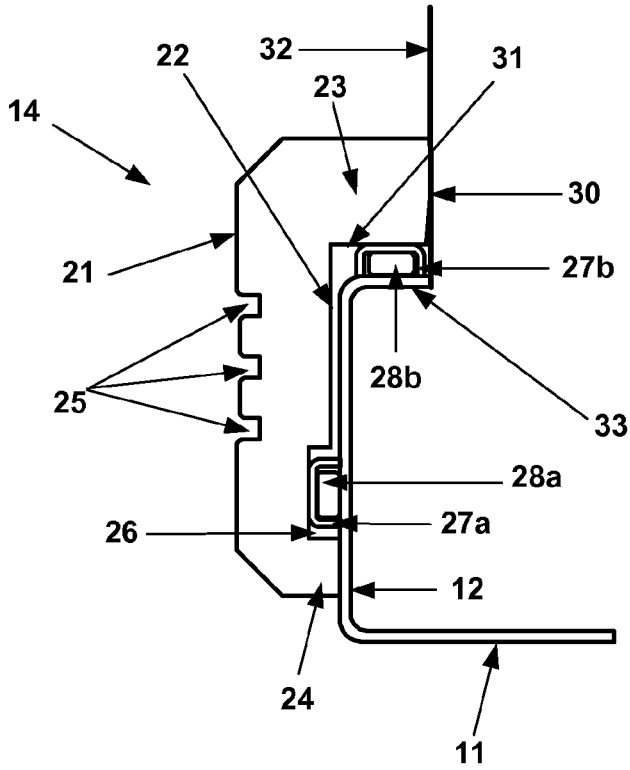
FIG. 3*b* illustrates a cross sectional view of a trim molding structure that is attached to a top horizontal flange of a metal frame.

A cross sectional view of one embodiment of a trim molding structure that is attached to a metal frame 11 is shown in FIGS. 3*a* and 3*b*. Among many possibilities, the metal frame 11 can be a metal door frame such as those commonly found in commercial buildings. The metal frame 11 can also be a metal window frame such as those in a hospital nursery. As shown in FIGS. 3*a* and 3*b*, a trim member 14 of the trim molding structure comprises an outer surface 21 with decorative grooves 25, an underside 22, a back leg 23 at one end and a front leg 24 at the opposite end from the back leg 23. The underside 22 comprises a groove 26. Within the groove 26, a metal clip 27*a* is affixed by an adhesive material that loses adhesiveness when its temperature exceeds approximately its temperature limit. A magnet 28*a* that is magnetically affixed to the metal clip 27*a* is used to magnetically attach the trim member 14 to the flange 12 of the metal frame 11. The magnet 28*a* does not need to make physical contact with the flange 12 to magnetically attach the trim member 14 thereto.

Continuing with FIGS. 3*a* and 3*b*, the back leg 23 comprises a bottom portion 30 that contacts the wall 32 adjacent to the metal frame 11. A metal clip 27*b* is attached to the inner side 31 of the back leg by an adhesive material that loses adhesiveness when its temperature exceeds approximately its temperature limit. A magnet 28*b* that is magnetically affixed to the metal clip 27*b* is used to magnetically attach the trim member 14 to the flange 12 of the metal frame 11. The magnet 28*b* does not need to make physical contact with the backend 33 of the flange 12 to magnetically attach the trim member 14 thereto.

Figure 4:
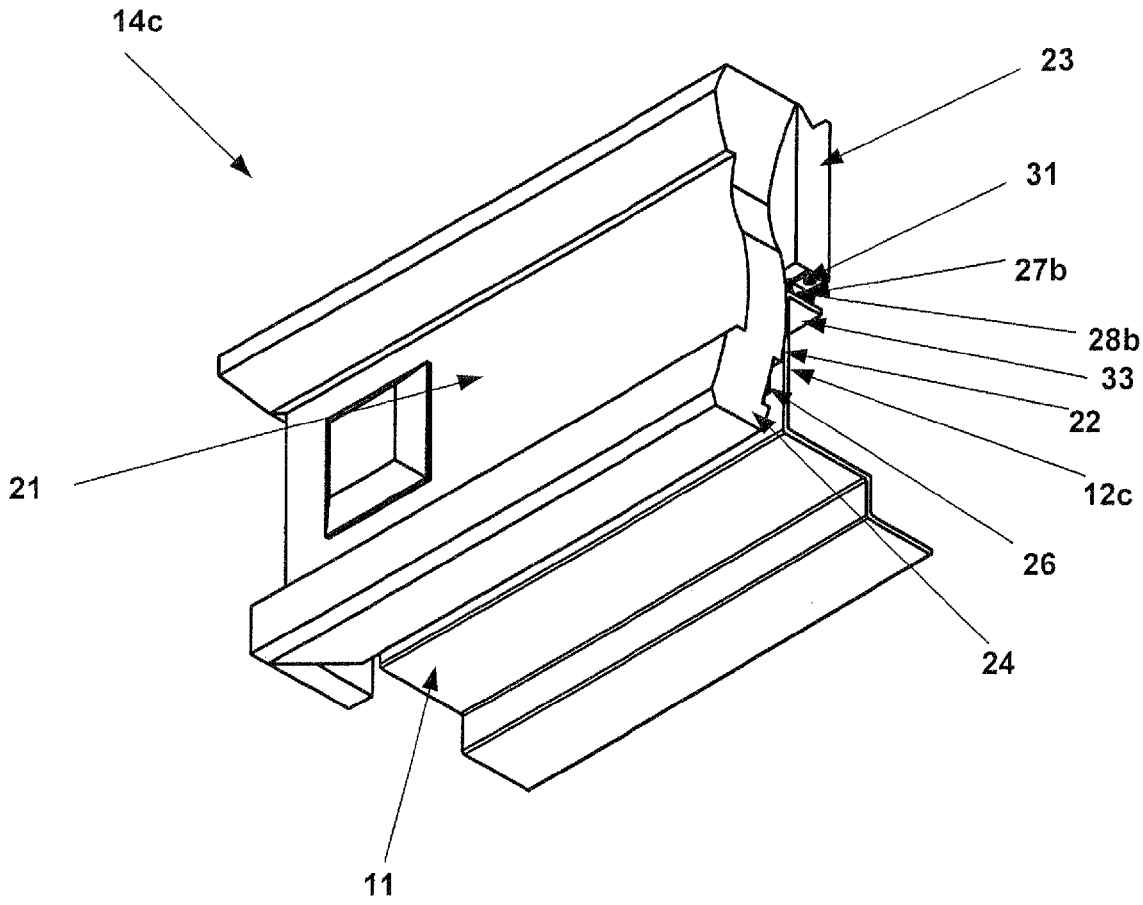
FIG. 4 illustrates a horizontal trim member.

In another embodiment of the trim molding structure, as shown in FIG. 4, a trim member 14*c* of a trim molding structure has an outer surface 21, an underside 22, a back leg 23 at one end and a front leg 24 at the opposite end from the back leg 23. The underside 22 comprises a groove 26. A metal clip 27*b* is affixed to the inner side 31 of the back leg 23 by an adhesive material that loses adhesiveness when its temperature exceeds approximately its temperature limit. A magnet 28*b* that is magnetically affixed to the metal clip 27*b* is used to magnetically attach the trim member 14*c* to the flange 12*c* of the metal frame 11. The magnet 28*b* does not need to make physical contact with the backend 33 of the flange 12*c* to magnetically attach the trim member 14*c* thereto.

Figure 5:
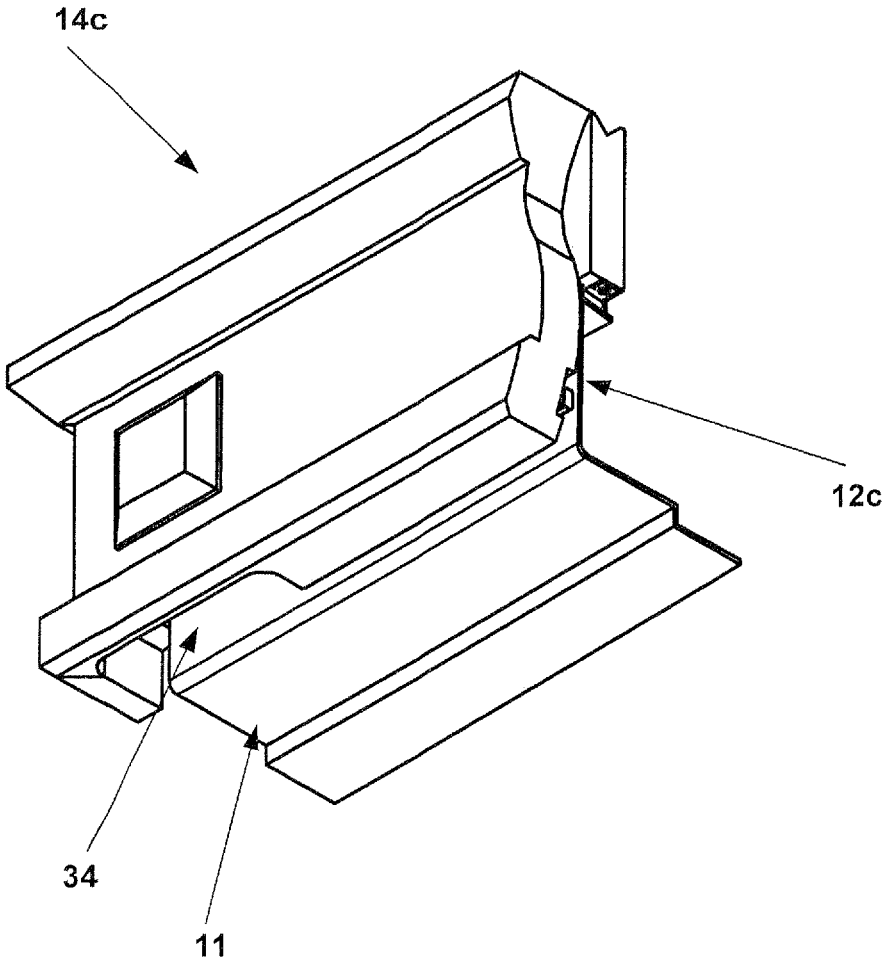
FIG. 5 illustrates a horizontal trim member that has a recessed section for the insertion of a vertical trim member.

A vertical trim member (14*a* and 14*b*), shown in FIG. 1, that is attached to a vertical flange (12*a* and 12*b*) can abut against a horizontal trim member 14*c* that is attached to a top horizontal flange 12*c*. In another embodiment, as shown in FIG. 5, a horizontal trim member 14*c* has a recessed section 34 into which the vertical trim member (14*a* and 14*b*) fits. The vertical trim member (14*a* and 14*b*) can move up and down within the recessed section 34. With a recessed section 34 at each end of a horizontal trim molding 14*c*, the same size vertical trim member (14*a* and 14*b*) can be attached to the vertical flanges (12*a* and 12*b*) of a metal frame 11 even when the two vertical flanges (12*a* and 12*b*) have a difference in height because of reasons such as uneven flooring below the flanges of a metal door frame.

Figure 6:
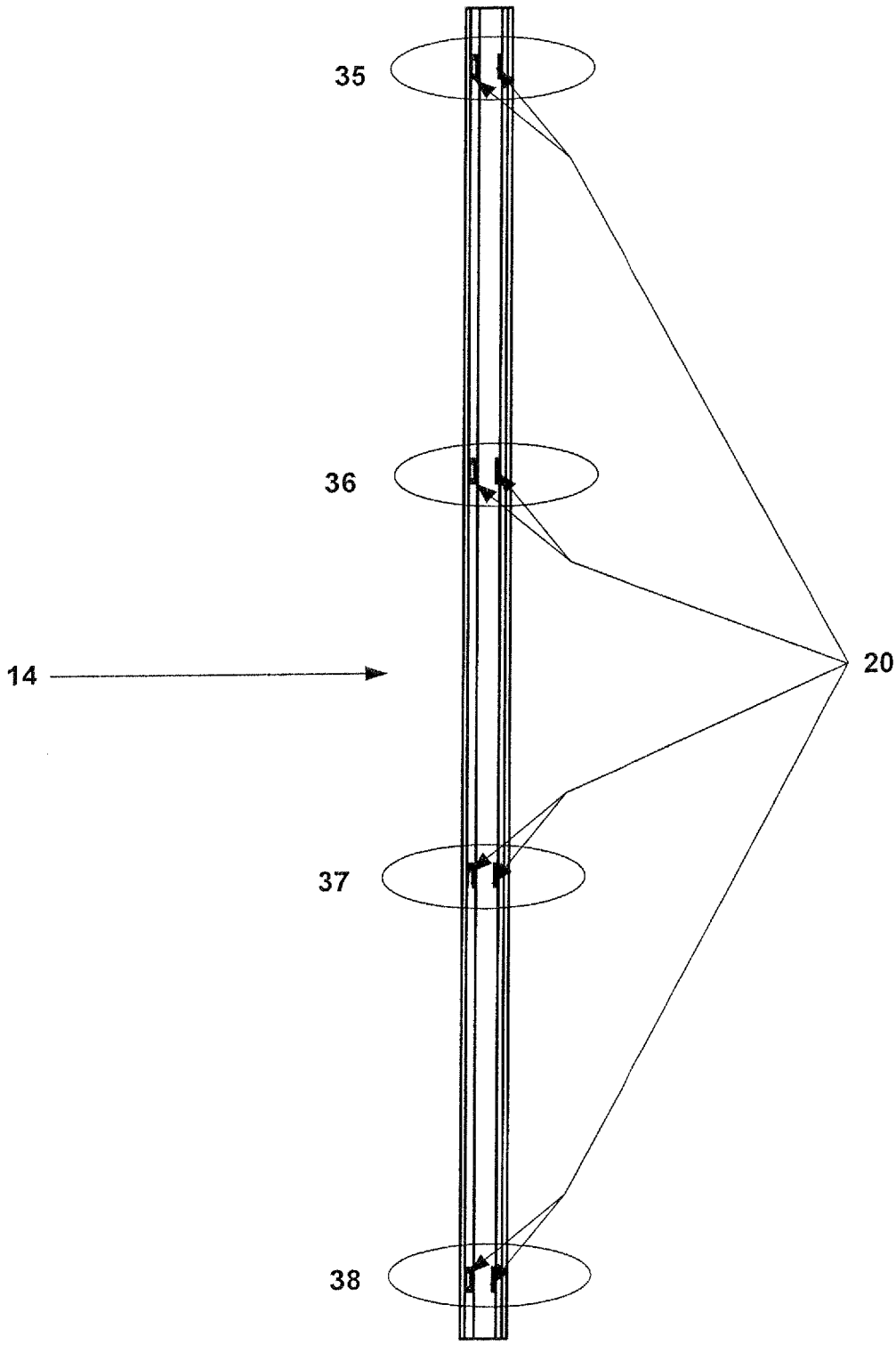
FIG. 6 illustrates a trim member of a trim molding structure with several magnetic elements affixed to it.
Figure 7A:
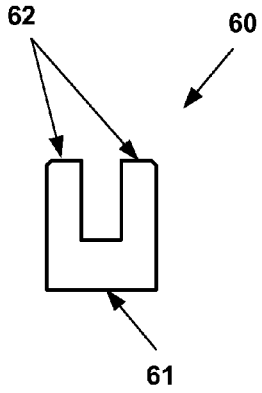
FIG. 7*a* illustrates an adapting structure for attachment to a trim member of a trim molding structure.
Figure 7B:
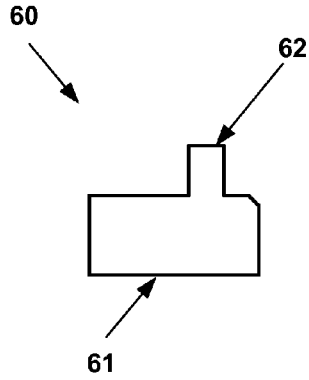
FIG. 7*b* illustrates an adapting structure for attachment to a trim member of a trim molding structure.
Figure 8A:
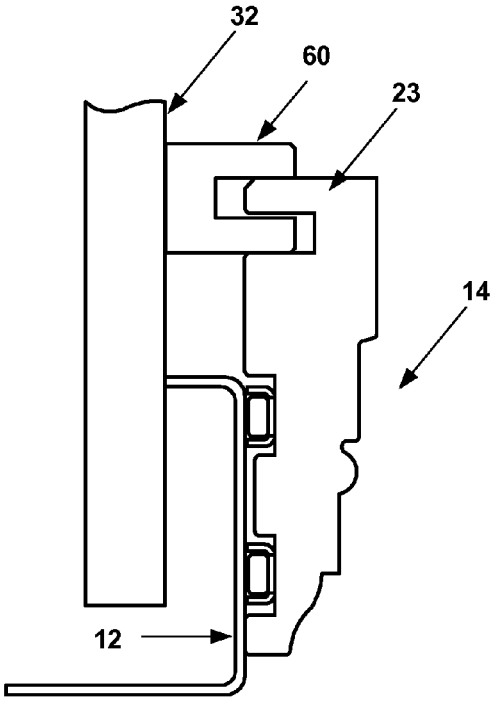
FIG. 8*a* illustrates a trim molding structure with the trim member interlocked with an adapting structure.
Figure 8B:
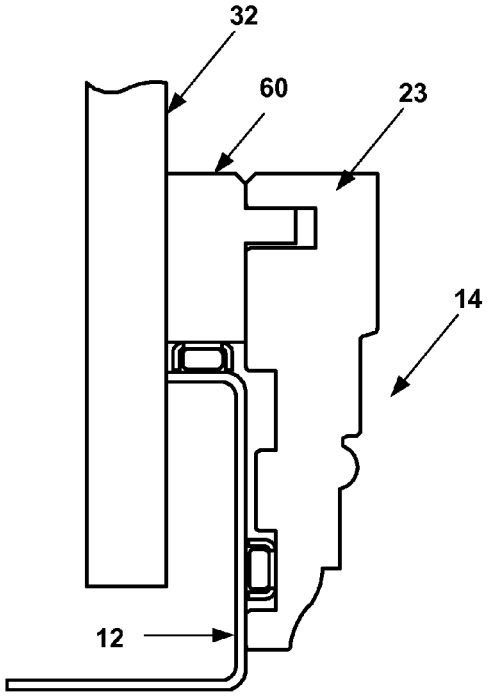
FIG. 8*b* illustrates a trim molding structure with the trim member interlocked with an adapting structure.

FIG. 6 shows an embodiment of a trim molding structure with magnetic elements 20 affixed along the length of a trim member 14. Two pairs 35 and 38 of magnetic elements 20 are affixed close to the two ends of the trim member 14. The other two pairs 36 and 37 of magnetic elements 20 are intermittently affixed between the first two magnetic pairs 35 and 38 of elements 20.

When a flange 12 of a metal frame protrudes far from a wall 32 adjacent to the metal frame 11, there may be a gap between the bottom portion 30 of a back leg 23 of a trim member 14 that is attached to the metal door frame and the wall 32 adjacent to the metal door frame 11. In such cases, an adapting structure 60, shown in FIGS. 7*a*, 7*b*, 8*a* and 8*b*, can be used to close the gap. The protruding projection 62 of the adapting structure 60 interlocks with the back legs 23 of a trim member 14 such that the base 61 of the adapting structure 60 makes contact with the wall 32 adjacent to the metal door frame 11.

Figure 9B:
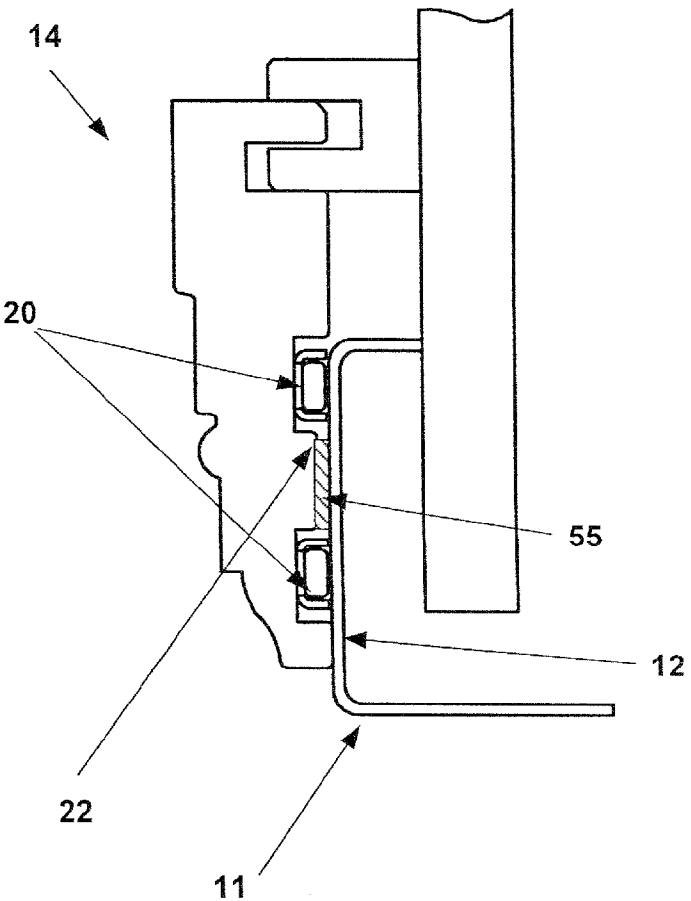
FIG. 9*b* illustrates a trim molding structure that has an intumescent material placed between the trim member and the flange.
Figure 9A:
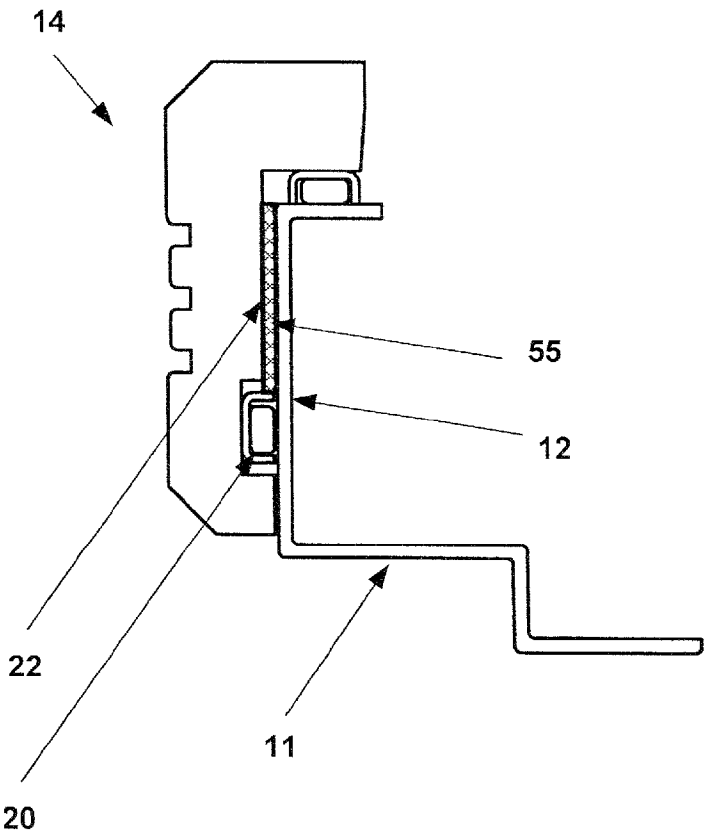
FIG. 9*a* illustrates a trim molding structure that has an intumescent material placed between the trim member and the flange.

In another embodiment of a trim molding structure shown in FIGS. 9*a* and 9*b*, an intumescent material 55 that is placed between a flange 12 of a metal frame 11 and trim member 14. The intumescent material can be affixed to the flange 12 or the underside 22 of a trim member 14, for example, using an adhesive material or other suitable means of attachment. The intumescent material 55 has an activation temperature such that it expands when its temperature exceeds approximately its activation temperature. Preferably, the activation temperature of the intumescent material 55 is higher than the temperature limit of the adhesive material that is used to affix the magnetic element 20 to the underside 22 of the trim member 14. Further, the activation temperature of the intumescent material is lower than the ignition temperature of the trim member 20. The intumescent material, such as Product No. FS3003 from ZERO International, expands when its temperature exceeds approximately 250 degrees Fahrenheit and can expand up to twenty times its normal size.

In one embodiment, the trim member 14 is made of wood which has an ignition temperature above approximately 500 degrees Fahrenheit. The temperature limit of the adhesive material used to affix the magnetic element 20 to the trim member 14 is approximately 200 degrees Fahrenheit. Further, the activation temperature of the intumescent material is approximately 250 degrees Fahrenheit. In case of a nearby fire, the adhesive material first loses its adhesiveness and releases the trim member 14 from the flange 12 of metal frame 11. The intumescent material 55 then expands and pushes the trim member 14 away from the flange 12 of the metal frame 11 before the trim member 14 ignites and spreads the fire.

Figure 10B:
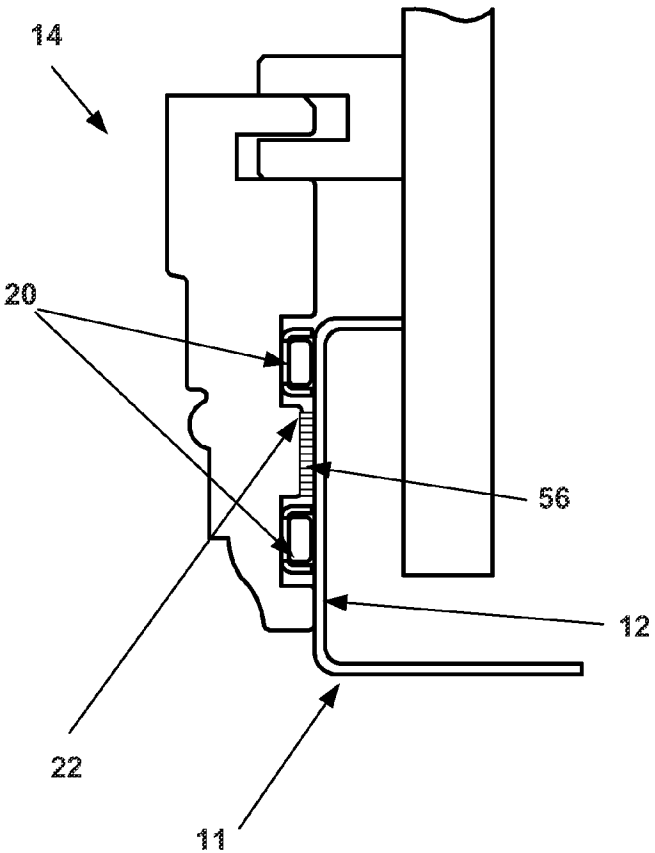
FIG. 10*b* illustrates a trim molding structure that has a spring placed between the trim member and the flange.
Figure 10A:
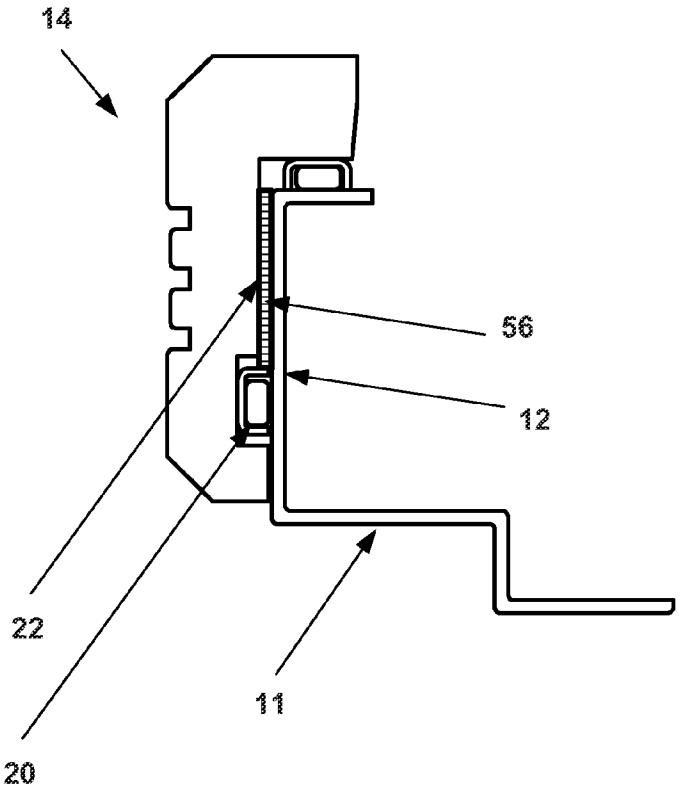
FIG. 10*a* illustrates a trim molding structure that has a spring placed between the trim member and the flange.

In another embodiment of a trim molding structure shown in FIGS. 10*a* and 10*b*, a spring 56 such as a finger spring or cone spring is placed between the trim member 14 and the flange 12 of the metal frame 11. The spring 56 is preferably compressed between the trim member 14 and the flange 12. A magnetic element 20 is affixed to the underside 22 of the trim member 14 by an adhesive material that has a temperature limit beyond which it loses its adhesiveness. In case of fire, when the adhesive material loses its adhesiveness, the spring pushes the trim member 14 away from the flange 12 of the metal frame 11 before the trim member 14 ignites and spreads the fire.

Accordingly, the trim molding structure for metal frames significantly eases the installation and removal process. Further, installation and removal of the trim molding structure does not disfigure or damage the metal frame or the wall adjacent to the metal frame. It also allows for adaptability to different site conditions because the magnetic elements do not require physical contact to attach the trim molding structure to the metal frame. Selection of magnet types can also be made based on site conditions, and magnets can be swapped at the time of installation. Additionally, the trim molding structure maintains the fire resistance quality of the metal frame to which it is attached by detaching from the metal frame before the trim molding structure ignites.

The foregoing description of preferred and other embodiments is not intended to limit or restrict the scope or applicability of the inventive concepts conceived of by the Applicants. In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A trim molding system comprising a ferrous metal frame and a trim molding structure, wherein the trim molding structure comprises:

a. A trim member adapted and dimensioned to attach to a flange of the ferrous metal frame, wherein the trim member has an ignition temperature below that of the ferrous metal frame;

b. A magnetic element affixed to the trim member by an adhesive material, wherein the magnetic element includes at least one magnet and the adhesive material has a release temperature limit below the ignition temperature of the trim member;

c. Wherein the adhesive material loses adhesiveness when a temperature of the adhesive material exceeds the release temperature limit of the adhesive material and the loss of adhesiveness releases and sufficiently separates said trim member from the flange such that ignition of the trim molding structure is avoided.

2. The trim molding system of claim 1, wherein the release temperature limit of the adhesive material is about 200 degrees Fahrenheit.

3. The trim molding system of claim 1, wherein the magnet is a rare earth magnet.

4. The trim molding system of claim 1, wherein the magnetic element comprises a ferrous metal clip affixed to the trim member and adapted to hold the at least one magnet.

5. The trim molding system of claim 1, wherein:

a. the trim member further comprises a vertical trim member and a horizontal trim member;

b. wherein the vertical trim member is adapted and configured to attach to a vertical flange of the ferrous metal frame;

c. wherein the horizontal trim member is adapted and configured to attach to a horizontal flange of the ferrous metal frame;

d. wherein the vertical trim member and the horizontal trim member connect by abutment.

6. The trim molding system of claim 1, wherein:

a. the trim member further comprises a vertical trim member and a horizontal trim member;

b. wherein the vertical trim member is adapted and configured to attach to a vertical flange of the metal ferrous frame;

c. wherein the horizontal trim member is adapted and configured to attach to a horizontal flange of the ferrous metal frame;

d. wherein the horizontal trim member has a recessed section;

e. wherein the vertical said trim member fits into the recessed section.

7. The trim molding system of claim 1, further comprising an adapting structure comprising a base and a protruding projection, wherein the protruding projection interlocks with the trim member and wherein the base of the adapting structure makes contact with a wall adjacent to the flange.

8. The trim molding system of claim 1, further comprising an intumescent material placed between the flange and the trim member, wherein the intumescent material has an activation temperature below the ignition temperature of the trim member and expands and pushes the trim member away from the flange when a temperature of the intumescent material exceeds the activation temperature of the intumescent material.

9. The trim molding system of claim 1, further comprising a spring placed between the flange and the trim member.

10. The trim molding system of claim 8, wherein the ferrous metal frame is a metal door frame or a metal window frame.

11. The trim molding system of claim 8, wherein the activation temperature of the intumescent material is about 250 degrees Fahrenheit.

12. The trim molding system of claim 11, wherein the temperature limit of the adhesive material is about 200 degrees Fahrenheit.

13. A trim molding system comprising a ferrous metal frame and a trim molding structure adapted and configured for attachment to a ferrous metal frame, the trim molding structure comprising:

a trim member and a plurality of magnetic elements affixed to the trim member, each magnetic element including at least one magnet, wherein the plurality of magnetic elements are adapted and configured to attach the trim molding structure to the ferrous metal frame without any modification of the ferrous metal frame prior to attaching the trim molding structure to the ferrous metal frame.

14. The trim molding system of claim 13, wherein the magnetic elements each comprise a ferrous metal clip affixed to the trim member and adapted to hold the at least one magnet.

15. The trim molding system of claim 13, further comprising an adapting structure, comprising a base and a protruding projection, wherein the protruding projection interlocks with the trim member, and wherein the base of the adapting structure makes contact with a wall adjacent to the ferrous metal frame.

16. The trim molding system of claim 13, wherein the trim member has an ignition temperature below that of the ferrous metal frame, and wherein the magnetic element is affixed to the trim member by an adhesive material having a release temperature limit below the ignition temperature, and the adhesive material loses adhesiveness when a temperature of the adhesive material exceeds the release temperature limit of the adhesive material and the loss of adhesiveness releases and sufficiently separates the trim member from the ferrous metal frame such that ignition of the trim molding structure is avoided.

17. The trim molding system of claim 16, further comprising a spring wherein the spring is placed between the ferrous metal frame and the trim member.

18. The trim molding system of claim 16, further comprising:

a. an intumescent material wherein the intumescent material is placed between the ferrous metal frame and the trim member;

b. wherein the intumescent material has an activation temperature below the ignition temperature of the trim member;

c. wherein the intumescent material expands and pushes the trim member away from the ferrous metal frame when a temperature of the intumescent material exceeds the activation temperature of the intumescent material.

19. The trim molding system of claim 18, wherein the activation temperature of the intumescent material is about 250 degrees Fahrenheit.

20. The trim molding system of claim 16, wherein the release temperature of the adhesive material is about 200 degrees Fahrenheit.

21. The trim molding system of claim 13, wherein:

a. the trim molding structure further comprises a vertical trim member and a horizontal trim member;

b. wherein the vertical trim member is adapted and configured to attach to a vertical flange of the ferrous metal door frame;

c. wherein the horizontal trim member is adapted and configured to attach to a horizontal flange of the ferrous metal door frame;

d. wherein the vertical trim member and the horizontal trim member connect by abutment.

22. The trim molding system of claim 13, wherein:

a. the trim molding structure further comprises a vertical trim member and a horizontal trim member;

b. wherein the vertical trim member is adapted and configured to attach to a vertical flange of the ferrous metal door frame;

c. wherein the horizontal trim member is adapted and configured to attach to a horizontal flange of the ferrous metal door frame;

d. wherein the horizontal trim member has a recessed section;

e. wherein the vertical said trim member fits into the recessed section.

23. A method of installing a trim molding structure on a preexisting ferrous metal door or window frame comprising the steps of:

affixing at least one magnetic element onto a trim member of the trim molding structure, each magnetic element including at least one magnet; and affixing the trim member to a flange of the preexisting ferrous metal door or window frame wherein the magnetic element magnetically attaches to the flange of the preexisting ferrous metal door or window frame, without installing any fastening devices to the preexisting ferrous metal door or window frame prior to affixing the trim member to the flange.

24. The method of claim 23, further comprising the step of affixing the at least one magnetic element to the trim member using an adhesive material that has a temperature limit, wherein the trim member has an ignition temperature below an ignition temperature of the preexisting ferrous metal door or window frame and above the temperature limit of the adhesive material and the adhesive material loses adhesiveness when a temperature of the adhesive material exceeds the temperature limit of the adhesive material and the loss of adhesiveness causes the trim molding structure to release and sufficiently separate from the preexisting ferrous metal door or window frame such that ignition of the trim molding structure is avoided.

25. The method of claim 24, further comprising the step of affixing an intumescent material between the trim member and the flange wherein the intumescent material has an activation temperature below the ignition temperature of the trim member, wherein the intumescent material expands and pushes the trim member away from the flange when a temperature of the intumescent material exceeds the activation temperature of the intumescent material.

26. The method of claim 23, further comprising the step of affixing a spring between the trim member and the flange.

27. The method of claim 23, wherein the trim member further comprises a vertical trim member adapted and configured to attach to a vertical flange of the ferrous metal frame and a horizontal trim member adapted and configured to attach to a horizontal flange of the ferrous metal frame, wherein the vertical trim member and the horizontal trim member connect by abutment.

28. The method of claim 23, wherein the horizontal trim member has a recessed section and the vertical trim member fits into the recessed section.

29. The method of claim 23, wherein the trim member further comprises an intumescent material placed between the flange and the trim member, wherein the intumescent material has an activation temperature below the ignition temperature of the trim member and wherein the intumescent material expands and pushes the trim member away from the flange when a temperature of the intumescent material exceeds the activation temperature of the intumescent material.

30. The method of claim 23, wherein the trim member further comprises a spring placed between the flange and the trim member.

31. The method of claim 23, wherein the trim member further comprises an adapting structure including a base and a protruding projection, wherein the protruding projection interlocks with the trim member, and wherein the base of the adapting structure makes contact with a wall adjacent to the ferrous metal frame.

* * * * *